United States Patent [19]

Frantz

[11] Patent Number: 4,568,135

[45] Date of Patent: Feb. 4, 1986

[54] SLIDE LATCH MECHANISM

[75] Inventor: Robert H. Frantz, Newville, Pa.

[73] Assignee: AMP Incorporated, Harrisburg, Pa.

[21] Appl. No.: 724,934

[22] Filed: Apr. 19, 1985

Related U.S. Application Data

[63] Continuation of Ser. No. 537,201, Sep. 29, 1983, abandoned.

[51] Int. Cl.[4] ..... H01R 13/639

[52] U.S. Cl. ..... 339/91 R; 339/75 M

[58] Field of Search ..... 339/91 R, 75 R, 75 M

[56] References Cited

U.S. PATENT DOCUMENTS

| | | | |
|---|---|---|---|
| 3,566,336 | 2/1971 | Johnson et al. | 339/91 R |
| 4,002,389 | 1/1977 | Mammel | 339/91 R |
| 4,172,627 | 10/1979 | Ricros | 339/75 M |
| 4,178,051 | 12/1979 | Kocher et al. | 339/45 M |
| 4,344,663 | 3/1982 | Ognier et al. | 339/75 M |
| 4,367,003 | 1/1983 | Frantz | 339/91 R |

*Primary Examiner*—John McQuade

*Attorney, Agent, or Firm*—Russel J. Egan

[57] ABSTRACT

A latching mechanism for securing a pair of electrical connectors together in a mated condition is formed by a latching member and spring mounted on the mating face of one connector and a pair of lugs mounted on the mating face of the other connector. Thus, the connectors are freed for the addition of other accessories, such as shielding housings. The mechanism is simplified by the spring directly acting between the latching member and the one connector.

4 Claims, 4 Drawing Figures

SLIDE LATCH MECHANISM

This application is a continuation of application Ser. No. 537,201 filed Sept. 29, 1983, now abandoned.

The present invention relates to a latching mechanism for joining electrical connectors in a mated condition and in particular to one which is mounted entirely on a forward mating face of the connector.

There are many well known latching systems for electrical connectors. Examples of some of the known devices can be found in U.S. Pat. Nos. 4,178,051, 4,067,633, 4,172,627, 4,344,663, and 4,367,003. While many of these prior art mechanisms are satisfactory in operation in providing one hand, two hand, or even one hand/one end operation of the latch, they are not universal in their ability to be applied to any connector, particularly those requiring shielding and having no available room to the rear of the connector. The present invention overcomes this difficulty by providing a latching mechanism which is mounted entirely on the forward mating end of the connector.

The present invention is a latching mechanism for securing together a pair of mated electrical connectors. The mechanism includes a pair of lugs integral with one connector member, a latching member slidable across the mating face of the other mating member, and a spring acting between the latching member and the other mating member. The latching lugs and the latching member are both mounted on the mating faces of the respective members leaving the rear portions open for attachment of ancillary devices, such as shielding.

The present invention will now be described by way of example with reference to the accompanying drawings in which.

Figure 1:
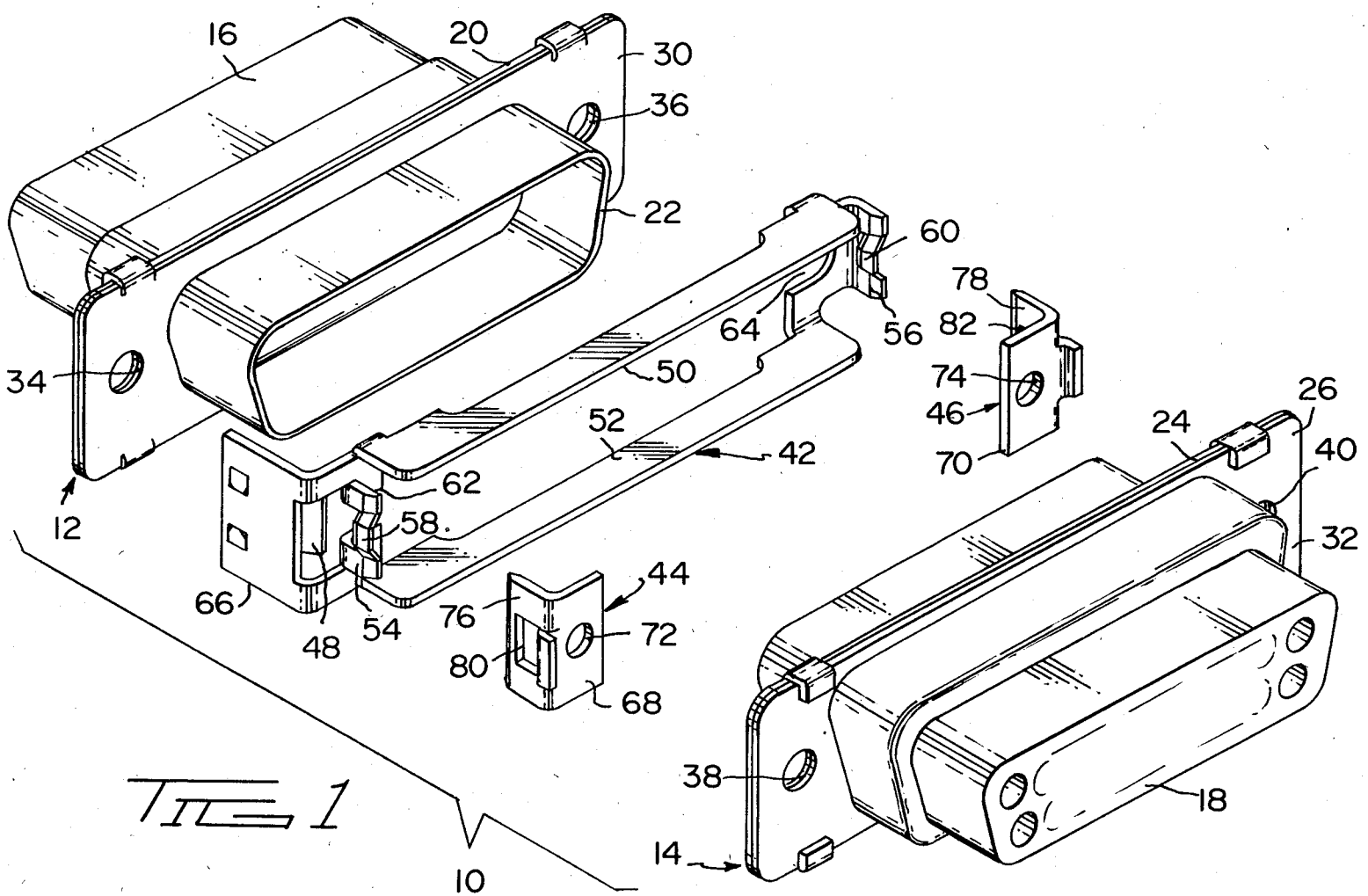
FIG. 1 is an exploded perspective view of a first embodiment of the subject invention.

The subject latching assembly 10 is used in conjunction with a mating plug member 12 and a mating receptacle member 14 of known configuration such as those shown in U.S. Pat. Nos. 3,101,229 or 3,879,099 or 4,062,616, the disclosures of which are incorporated herein by reference. There are generally the type of electrical connector known in the industry as a "D" or "subminiature D" connector. The plug and receptacle members 12, 14 each include housings 16, 18 of insulative material carrying a plurality of pin and receptacle terminals (not shown). Each member is enclosed within a two piece metal shell 20, 22, 24, 26 with each shell defining a peripheral flange 30, 32 with mounting holes 34, 36, 38, 40 at each end of the respective flanges.

The present invention includes an elongated latching member 42, a pair of latching lugs 44, 46 and a spring 48. The latching member 42 is an elongated member having a pair of parallel spaced side rails 50, 52 joined at the ends by transverse portions defining upstanding lugs 54, 56, each with a projection 58, 60 and slot 62, 64. The latching member 42 further includes an end wall 66 extending normal to the direction of movement of the latching member. The spring 48 is mounted in cantilever fashion on the end wall 66.

Each lug 44, 46 has a mounting portion 68, 70 provided with an aperture 72, 74 and a latching portion 76, 78 extending normal to the mounting portions and containing a latching aperture 80, 82.

The latching member 42 is slidably secured to the front face of the plug member 12 by bolts 84 which pass through the mounting holes 34, 36 and are received in the slots 62, 64. It will be appreciated from FIG. 2 that this mounting arrangement allows for limited lateral movement of the latching member 42 and that the reaction of the spring 48 is between one end of the flange 30 and the end wall 66. It should also be noted from this figure that, should it be desired, the end wall 66 can be formed in the opposite direction, that is to say in the same direction as the lugs 54, 56, if spacing makes such a requirement. The latching lugs 44, 46 are mounted on the respective ends of the flange 32 by bolts 86 passing through the holes 72, 38 and 74, 40, respectively.

Figure 2:
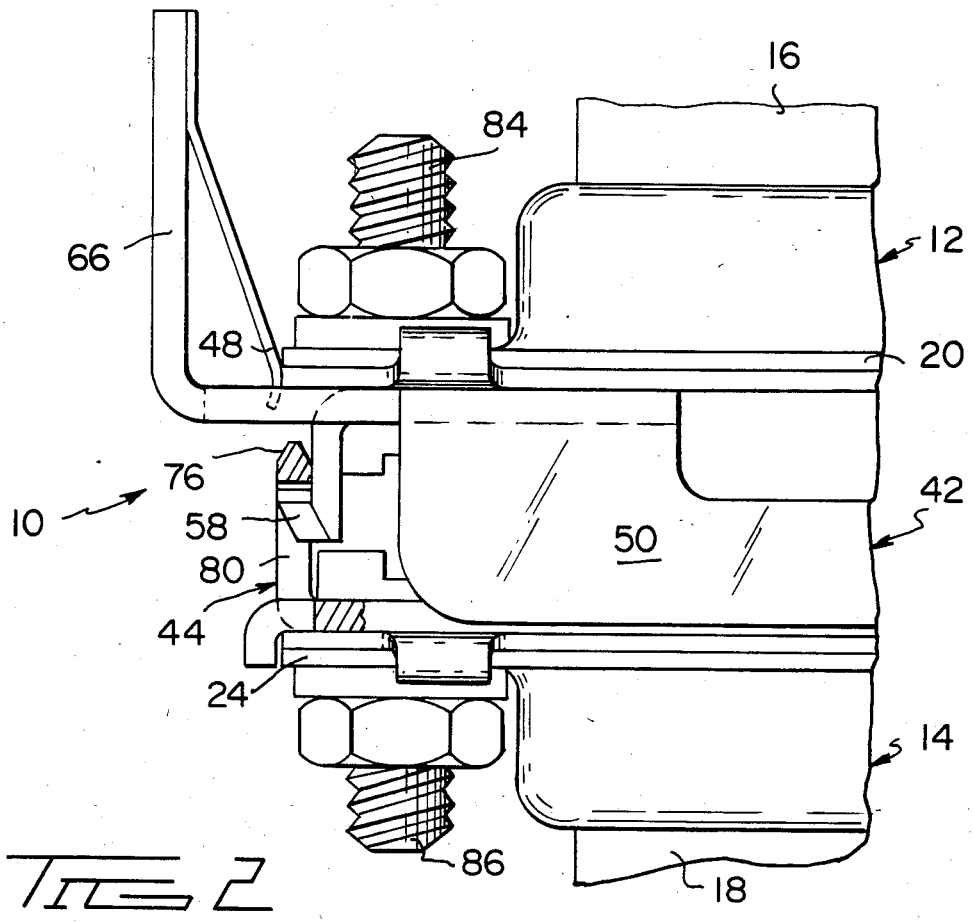
FIG. 2 is an enlarged side elevation of an end portion of the subject invention.
Figure 3:
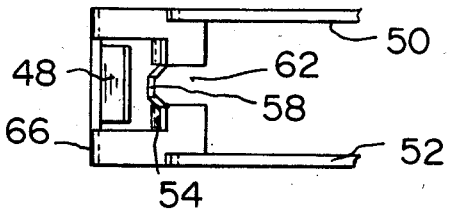
FIG. 3 is a plan view of one end of the latching member.

The operation of the subject latching device should be readily apparent to those skilled in the art. Likewise, the advantages of the front face mounting should be apparent. Movement of the latching number 42 to the right in the drawings would compress the spring 48 between end wall 66 and metal shell 20 and allow the projections 58, 60 to move past the latching portions 76, 78. The plug member and receptacle members 12, 14 can now be mated. In the mated condition the latching member 42 is released and driven to the left by force of the spring 48 acting against metal shell 20 to bring the projections 58, 60 into the apertures 80, 82, as shown in FIG. 2, to latch the members 12, 14 together.

Figure 4:
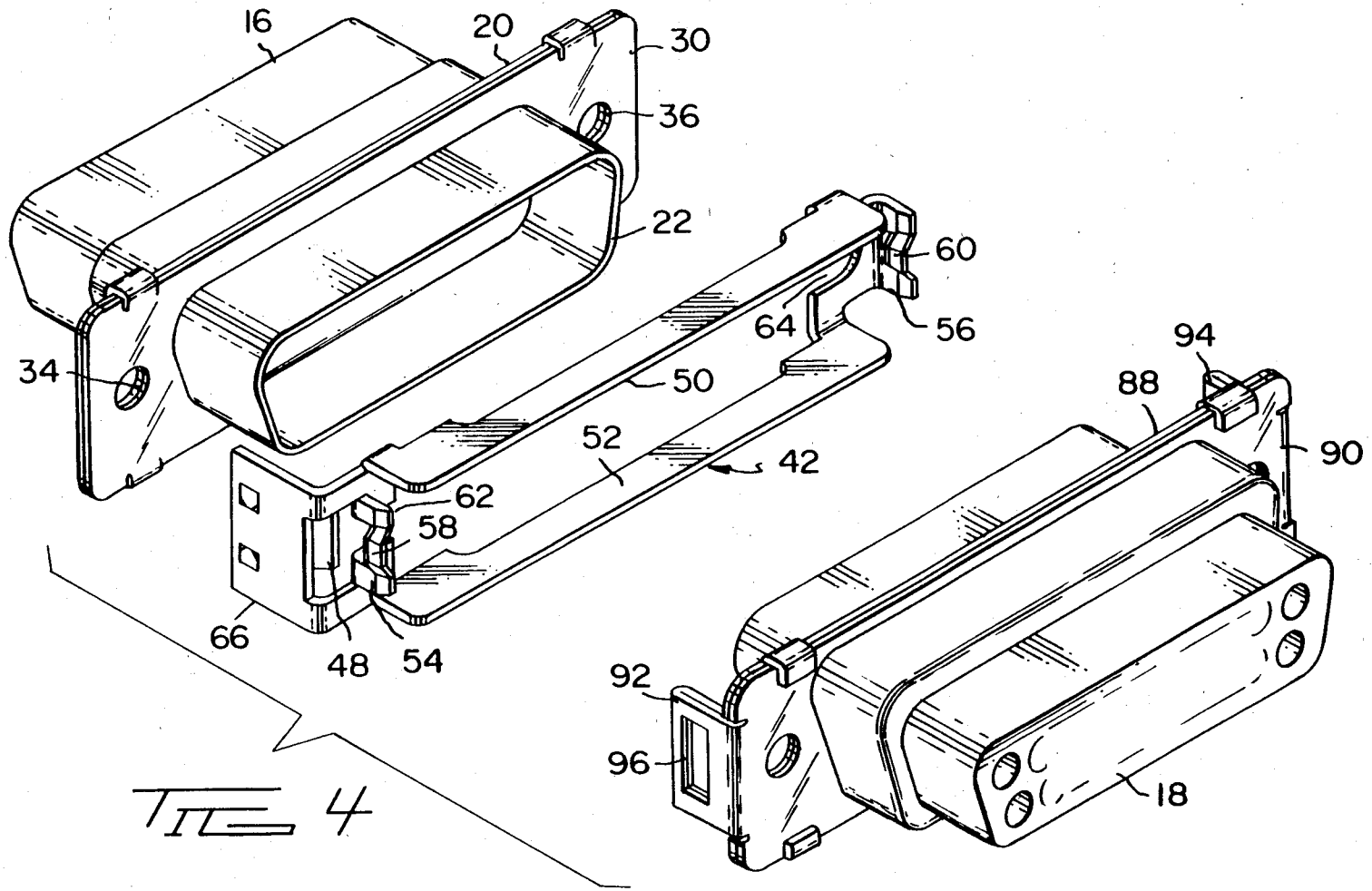
FIG. 4 is an exploded perspective view, similar to FIG. 1, showing an alternate embodiment of the present invention.

The alternate embodiment of the subject invention is shown in FIG. 4 with the change being that the lugs on the receptacle member are formed as integral portions of the shells. In this embodiment lugs 92, 94 are formed at the opposite ends of and integral with at least one of the shells 88. 80. Each of the lugs 92, 94 has an aperture 96 therein to receive projections 58, 60 of the latching member 42.

I claim:

1. A latching mechanism for latchably securing complementary D-type electrical connectors and like elongate connectors, each said connector being of the type having a peripheral flange with a mounting hole through each end thereof, said latching mechanism being of the type comprising a stamped and formed metal latching member carried by one of said connectors for sliding movement relative thereto in the elongate direction, cooperable latching means fixed to the flange of the other said connector, and spring means effective between said latching member and said one of said connectors to urge said latching member into latching engagement with said cooperable latching means when said connectors are mated, wherein said spring means is fixed to said latching member, said spring means bearing directly against said peripheral flange of said one connector to urge said member into latching engagement with the cooperable latching means on the other connector.

2. Latching mechanism as in claim 1 wherein said latching member is provided with a pair of slots which align with respective mounting holes at opposite ends of said flange on said one connector, said slots receiving respective bolts therethrough for slidably mounting said latching member against said flange, said bolts being secured to respective holes in said flange.

3. Latching mechanism as in claim 1 wherein said latching member is mounted against the mating face of said flange on said one connector.

4. Latching mechanism as in claim 1 wherein said cooperable latching means is fixed against the mating face of said flange on said other connector.

* * * * *